United States Patent [19]

Lebow

[11] Patent Number: 5,002,152

[45] Date of Patent: Mar. 26, 1991

[54] FALL RESTRAINT CABLE SUPPORT AND METHOD

[76] Inventor: Dwight R. Lebow, 465 Southern Oaks Dr., Lake Jackson, Tex. 77566

[21] Appl. No.: 529,963

[22] Filed: May 29, 1990

[51] Int. Cl.[5] ..... E04G 21/32; A62B 35/00

[52] U.S. Cl. ..... 182/3; 182/191

[58] Field of Search ..... 182/3–9, 182/191

[56] References Cited

U.S. PATENT DOCUMENTS

| | | | |
|---|---|---|---|
| 595,555 | 12/1897 | Brennan . | |
| 1,794,998 | 3/1931 | Weinberger . | |
| 1,899,162 | 2/1933 | Lackner | 182/3 |
| 2,495,477 | 1/1950 | Raitt . | |
| 2,496,990 | 2/1950 | Downing . | |
| 2,884,249 | 4/1959 | Cunningham . | |
| 3,193,050 | 7/1965 | Galante . | |
| 3,217,833 | 11/1965 | Smith | 182/3 |
| 3,237,717 | 3/1966 | Jackson | 182/3 |
| 3,429,535 | 2/1969 | Herzig . | |
| 3,860,089 | 1/1975 | Hugget . | |
| 4,313,236 | 2/1982 | Tupper et al. . | |
| 4,606,430 | 8/1986 | Roby | 182/3 |
| 4,633,974 | 1/1987 | Weiner | 182/3 |
| 4,674,596 | 6/1987 | Weiner | 182/3 |
| 4,699,245 | 10/1987 | Benedet . | |
| 4,721,182 | 1/1988 | Brinkmann . | |
| 4,790,410 | 12/1988 | Sharp et al. . | |

FOREIGN PATENT DOCUMENTS

| | | |
|---|---|---|
| 2615742 | 12/1988 | France . |
| 1178885 | 9/1985 | U.S.S.R. . |
| 1178886 | 9/1985 | U.S.S.R. . |

*Primary Examiner*—Reinaldo P. Machado
*Attorney, Agent, or Firm*—Browning, Bushman, Anderson & Brookhart

[57] ABSTRACT

An improved intermediate support is provided for ensuring the safety of a worker while moving relative to a fixed structure at elevated locations, with the worker being secured by a lanyard to a safety or fall restraint cable. The intermediate support is secured to the fixed structure, and includes a supporting plate having a notch along the periphery thereof for receiving the safety cable, and a pair of opposing hook members positioned on opposite sides of the supporting plate. The hook members prevent the safety cable from inadvertently or intentionally moving out of the notch. The method of the present invention ensures that an end of the lanyard secured to the safety cable may be quickly and easily moved sequentially past one hook member, then the supporting plate, and then the other hook member to allow the worker to efficiently and safely move past the intermediate support.

20 Claims, 2 Drawing Sheets

FALL RESTRAINT CABLE SUPPORT AND METHOD

BACKGROUND OF THE INVENTION

1. Field of the Invention

The present invention relates to safety devices for persons at elevated locations and, more particularly, relates to an improved device for safely supporting a workman tied off with a lanyard and safety harness to a cable, while allowing the lanyard to be easily and quickly moved along the cable and past a cable support.

2. Description of the Background

Government and industry regulations require that personnel working at elevated positions be "tied off" for safety. One popular type of safety system employs a fall restraint cable permanently secured at each end to a building structure, pipeway rack, etc. A tether line has a conventional safety hook at one end, and a safety harness at the other end worn by the worker. The worker attaches the safety hook (and thus himself) to the fall restraint cable, which is stretched taunt and tied off between supports. As a worker moves in a direction along the cable, the lanyard or safety hook slides over the cable.

In order to limit the distance a worker can fall, regulations limit the length of the tether, and also require the fall restraint cable to be supported at regular intervals, e.g., at least every 20 feet. These intermediate cable supports are typically a short section of pipe which is secured to the structure, with the cable passing through the section of pipe. The problem exists, however, that the lanyard cannot pass by this intermediate support. Either the worker fails to tie off when switching the lanyard from one side of the intermediate support to the other side (a violation of regulations), or he must carry two lanyards and connect the second lanyard to one side of the intermediate support before unhooking the first lanyard from the other side of the intermediate support.

Other prior art safety devices have been devised which do not utilize the fall restraint cable as the primary support for restraining the worker if he should fall. U.S. Pat. No. 3,860,089 discloses an elongated plastic tube with a continuous entrance slot for receiving a block connected to a safety line. U.S. Pat. No. 4,721,182 teaches a guide rail supported by fasteners. A safety rod connects the worker to the guide rail through a closable end piece. Neither of these patents utilize a conventional taunt fall restraint cable, which has become widely accepted in the industry.

U.S. Pat. No. 3,193,050 discloses a device for securing a safety line for a workman operating at elevated places. The device disclosed in this patent includes a spring hook ring which passes by a plate and bracket member. The spring hook ring must be passed through an opening in the plate, and positioned through a series of movements to pass by the plate and the shaft. These complicated movements greatly detract form the desired simplicity of the intermediate support, and accordingly the device as taunt by this patent has not been widely accepted.

U.S. Pat. No. 4,699,245 also discloses a safety system which utilizes a taunt cable and intermediate supports. The intermediate supports are designed for fastening to a fixed wall or other fixed member in the position as shown in the figures. More importantly, the intermediate support includes a disk which rotates about an axis.

Intermediate supports with movable components, as disclosed in the '245 patent, are not favored in the safety industry, in part because such supports are more likely to fail than a support with no moving parts. Debris, corrosion, and other elements may prohibit the movable components from operating, although this problem cannot be easily detected before the workman tries to pass the lanyard along the fall restraint cable past the intermediate support. If the disk as shown in the '245 patent becomes locked or seized to the shaft, the workman is not likely to repair the intermediate support, but rather is more inclined to unhook his lanyard from one side of the intermediate support and then rehook his lanyard on the other side of the intermediate support. This detachment and reattachment of the lanyard violates the one-hundred percent tie off regulation, and obviously subjects the worker to a high safety risk if he should slip while the lanyard is disconnected from the fall restraint cable.

U.S. Pat. No. 4,790,410 discloses another type of safety system for connecting a workman to a fall restraint cable. A coupling device which includes a helical longitudinal slot is passed through a support secured to the fall restraint cable. An arm may be secured to the coupling, and safety line or tether is attached at one end to the arm. The intermediate support includes a head portion with tapered ends, and a post interconnects a fixing plate to the head portion. A workman rotates the coupling device and arm to pass the post through the helical slot, thereby allowing the coupling device to pass from one side to the other of the intermediate support. Alternatively, a slotted tube having a helical passageway may be secured to the building, and a coupling component including a tubular head portion receives the cable and passes through the helical slot in the tube. The device as disclosed in the '410 patent requires that one component rotate 360° about the axis of the cable to pass by the intermediate support, which is a significant disadvantage of the device. Also, the device requires both a specially fabricated and expensive intermediate support and a specially fabricated member for securing the conventional hook at the end of the tether to the safety cable. Accordingly, this device has the disadvantage of both an expensive intermediate support and a special device which must be used to secure the safety cable to the tether hook.

Soviet Union Disclosure No. 1178866 teaches intermediate supports for a safety or fall restraint cable. The intermediate support is a section of casing with a sinusoidal groove having an axis of symmetry in the plane of the axis of the support. A significant although not readily apparent disadvantage of this device, which is also a disadvantage of the prior art intermediate supports comprising short sections of pipe discussed earlier, is that birds tend to build nests within the short pipe section. Again, the safety hook must be weaved through the sinusoidal groove in the tube, and can become stuck, especially if nests or other debris are contained within the section of pipe. French Patent No. 2615-742 discloses a similar intermediate support fabricated from a rectangular housing rather than a section of pipe, and includes an inverted V-shaped slot rather than a sinusoidal groove. Soviet Union Disclosure No. 1,178,855 discloses a support for a safety cable which uses a wheel having radially outward spokes for supporting the cable. This device is expensive to manufacture, and requires moving parts which must rotate about an axis.

Accordingly, this device has many of the disadvantages discussed above with respect to U.S. Pat. No. 4,699,245.

The disadvantages of the prior art are overcome by the present invention, and an improved fall restraint cable support and method are hereinafter disclosed suitable for providing intermediate support to a safety cable while allowing a conventional hook, ring or clasp at the end of a tether to easily and quickly pass by the intermediate support.

SUMMARY OF THE INVENTION

The present invention provides the desired intermediate support for a fall restraint cable stretched between and anchored at each end to a building structure or other suitable supporting member. The device comprises a base plate which may by bolted to a suitable structure, such as an I-beam, a supporting plate welded to the base plate and including a notch for receiving the cable, and a pair of J-shaped hooks on opposing sides of the supporting plate. The supporting plate provides the desired support for the fall restraint cable, and the J-shaped hooks prevent the intentional or inadvertent positioning of the fall restraint cable outside the notch in the supporting plate.

Two embodiments of the invention are disclosed in detail. In the first embodiment, the device is mounted such that the notch in the supporting plate is at the uppermost end of the plate. The base of the notch thus provides the support of the safety cable. In the second embodiment, the unit is mounted such that the notch is at one side of the supporting plate. In this case, the lowermost side of the notch serves as a support for the safety cable. In each embodiment, the J-shaped hooks are mounted so that their curvilinear portions prevent the cable from passing out the slot in the supporting plate, and the opening in each J-hook is directed toward the base member. Preferably the J-hooks are arranged in opposing relationship, so that the ends of the J-hooks are on opposing sides of the fall restraint cable.

It is an object of the present invention to provide an improved intermediate support for a safety or fall restraint cable which the worker can easily and quickly pass by without disconnecting the safety tether from the cable.

It is another object of the invention to provide an intermediate safety support which is relatively simple and inexpensive, and does not require moving parts.

Still another feature of the invention is an improved intermediate support which does not allow the safety cable to be intentionally or inadvertently removed from the support.

It is a feature of the present invention that the intermediate support can be mounted at various orientations to conventional fixed structures.

Another feature of this invention is an intermediate support which does not require special provisions for attaching a lanyard to the cable.

It is also a feature of this invention that a plate serve as the supporting member for the cable, such that the plate can reliably withstand a load in excess of 5000 lbs.

It is a significant advantage of this invention that the intermediate support is designed such that the worker can easily pass the safety hook past the intermediate support without disconnection from the safety cable.

Still another advantage of this invention is that the immediate support is constructed such that debris and other matter cannot easily become lodged within the intermediate support and thus obstruct the passage of the lanyard past the intermediate support.

These and further objects, features and advantages of the present invention will become apparent from the following detailed description, wherein reference is made to the figures in the accompanying drawings.

DETAILED DESCRIPTION OF THE PREFERRED EMBODIMENTS

Figure 1:
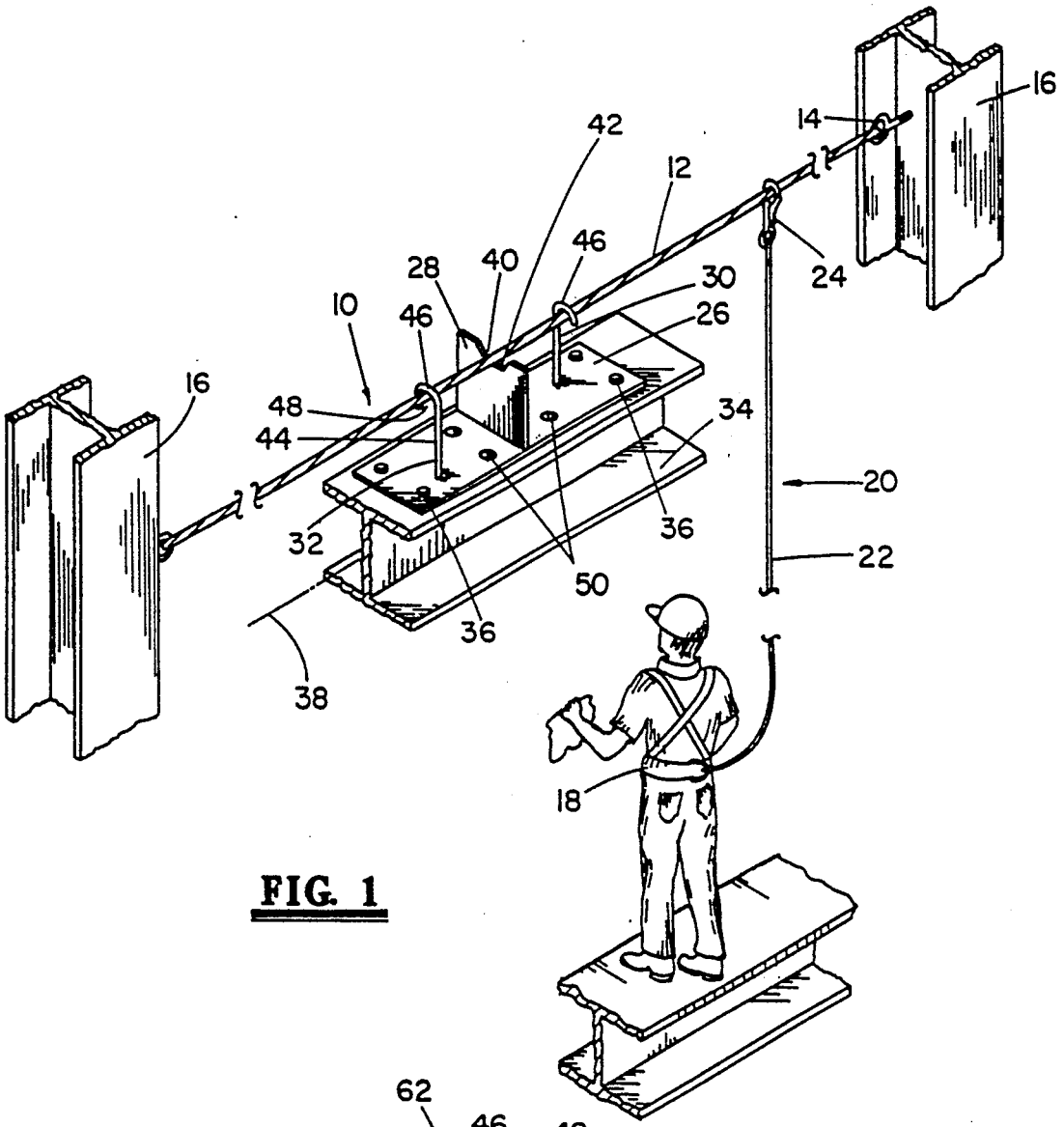
FIG. 1 is a pictorial view illustrating one embodiment of intermediate support according to the present invention, and further showing a worker tethered to the fall restraint cable by a conventional hook.

FIG. 1 depicts one embodiment of an intermediate support 10 according to the present invention. A fall restraint of safety cable 12 may be secured at each end by a conventional member 14 to I-beam 16 or other suitable fixed structure. The cable 12 is stretched taunt prior to being affixed to the structure, although some slack or "play" in the cable will typically be present. A worker movable at elevated locations relative to the structure typically wears a safety harness 18. A lanyard 20 comprises a tether line 22 and a safety clasp or hook 54 secured at one end to the tether line. The tether line is conventionally fastened at one end to the safety harness 18, while the safety clasp at the other end of the line 22 encircled and is thus connected to the fall restraint 22 while allowing the clasp and thus the worker to move in either direction along the fall restraint cable. The fall restraint or safety cable 12 is secured to the fixed structure 16 such that the cable 12 is substantially horizontal.

Although only one intermediate support is depicted in FIG. 1, it should be understood that a plurality of such supports may be provided at regular intervals, e.g., every 20 feet, along the length of the fall restraint or safety cable 12. Also, various safety cables 12 are provided at different locations within and preferably are a permanent component of the structure, and the intermediate supports according to the present invention are provided along the length of each of these safety cables. The length of the tether 20 and the spacing between intermediate supports is regulated to ensure that, if a worker should slip, the safety cable will restrict the worker's fall and prevent substantial injury or death. While such intermediate supports are thus critical to the worker's safety, the present invention allows the worker to quickly and easily pass the clasp 14 along the cable 12 past the support 10, i.e. from one side of the support to the other side of the support. The ease of operation and high reliability of the intermediate support 10 thus significantly contributes to the worker's safety by substantially reducing the likelihood that the worker will disregard established safety practices and unhook the clasp 24 from the cable then rehook the clasp to the cable to avoid passing the clasp along the cable past the intermediate support.

The intermediate support 10 depicted in FIG. 1 comprises a base plate 26, a supporting plate 28, and a pair of opposing hook members 30, 32 on opposite sides of the supporting plate. As shown in FIG. 1, the intermediate support 10 is secured to another available I-beam 34 of the fixed structure by a plurality of conventional bolts 36. The base plate 26 defines a plane which, when the intermediate support 10 is secured to the structure as shown in FIG. 1, is substantially horizontal, while the supporting plate 28 fixed to the base plate defines a plane which is substantially vertical and perpendicular to the central axis 38 of the beam 34. The plate 28 provides the sole structural support for the fall restraint cable 12, and includes a notch 40 having an entry along the periphery of the plate and in the uppermost portion thereof. The notch 40 thus defines a supporting surface 42 which is below the cable 12 and which the cable actually engages if a downward force is exerted on the cable. Each hook member 30,32 is preferably formed from a metal rod, and comprises an elongate post portion 44 and a restriction portion 46 at the free end of the post portion. The restriction portion 44 preferably is U-shaped, with a mouth opening 48 generally directed toward the base plate 26 and away from the supporting surface 42. Accordingly, each hook 32, 34 has a generally J-shaped configuration, and the hooks, 32, 34 are fixed on opposing sides of the supporting plate. Also, the hooks 32, 34 are fixed to the base plate such that the post portion of hook 32 is on one side of the cable 12 while the cantilevered end of the restriction portion of the hook 32 is on the other side of cable 12, while the post portion of hook 34 is on the other side of the cable 12 and the cantilevered end of the restriction portion of the hook 34 is on the one side of the cable 12.

Figure 2:
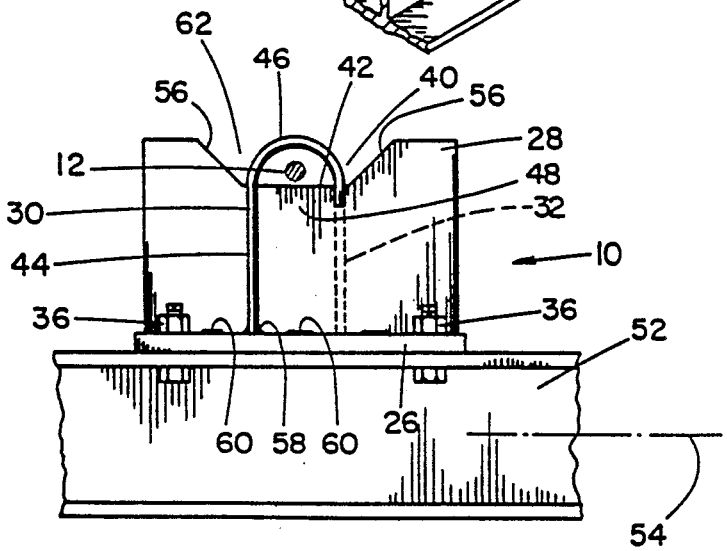
FIG. 2 is a end view of the intermediate support shown in FIG. 1 attached at a different orientation to an I-beam.

FIG. 2 depicts the same intermediate support 10 shown in FIG. 1, although the intermediate support is secured by conventional bolts 36 to another beam 52 having a central axis 54. When the intermediate support is affixed to the beam 34 as shown in FIG. 1, the apertures adjacent the ends of the base plate 26 may be used for bolting the support 10 to the structure, while the inwardly spaced apertures 50 (see FIG. 1) are used to bolt the support 10 to the beam 52 shown in FIG. 2. Accordingly, it should be understood that in FIG. 2 the plane defined by the base plate is substantially perpendicular to the axis 54 of the supporting beam 52, while the plane defined by the supporting plate is substantially parallel to the axis 54.

FIG. 2 illustrates notch 40 defining a horizontal supporting surface 42, and tapered sidewalls 56. The J-hooks 32, 34 preferably provide a slight gap between the cable 12 and that part of each restriction portion 46 which is directly above the cable 12. The entry 62 of the notch 40 is provided along the periphery of the supporting plate 28 and the notch 40 is in an uppermost portion of the supporting plate. FIG. 2 also depicts the J-hooks secured to the base plate 26 by weld 58, while the supporting plate is preferably fixed to the base plate by one or more welds 60.

Referring to FIGS. 1 and 2, the method of the present invention ensures the safety of a worker movable relative to a fixed structure at elevated locations, with the worker connected to one end of a tether line. A safety cable is secured at each end to the structure, and is generally taunt. The end of the tether line opposite the worker is connected to the safety cable with a clasp or hook which allows the tether line to move along the safety cable. At least one or generally a plurality of intermediate supports are provided, each of which may be of the type as shown in FIGS. 1 through 4. Each intermediate support is secured to the structure such that an engaging surface defined by the notch is spaced below the safety cable, and limits downward movement of the safety cable if the worker should fall. For the embodiment shown in FIGS. 1 and 2, the worker moves the hook or clasp at the end of the tether line along the safety cable and past the intermediate support by positioning the clasp so that the tether line can pass through the opening 48 of the J-hook 30, then moves the clasp so that the tether line passes above the plate 28, and finally orienting the clasp 24 so that the tether line 22 passes through the opening 48 in the J-hook 32. This movement of the clasp and end of the tether line by the worker is quickly and easily accomplished, typically in a few seconds. The intermediate support does not include any moving parts, and the intermediate support is simple and relatively inexpensive. Even with some slack or "play" in the fall restraint or safety cable 12, the J-hooks 30 and 32 do not allow the safety cable to be intentionally or inadvertently removed from the notch 40 in the supporting plate 28.

Figure 3:
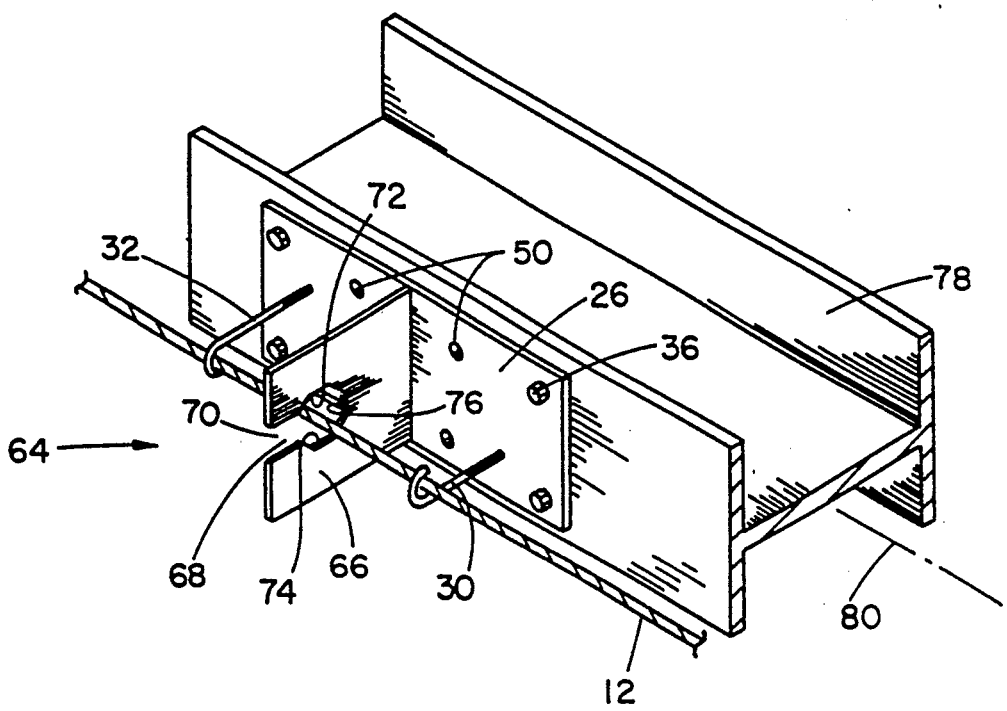
FIG. 3 is a pictorial view of an alternate embodiment of an intermediate support according to the present invention.

FIG. 3 depicts another embodiment of an intermediate support 64 according to the present invention for supporting a safety cable 12. The intermediate support 64 may include a base plate 26, bolt and nut assemblies 36, additional bolt apertures 50, and J-hooks 30,32 as previously described. Supporting plate 56 is fixed perpendicular to the base plate, and includes a notch 68 having an entry in the side edge of the periphery of plate 66. While the configuration of the notch 68 may take on various arrangements, the assembly 64 is designed to be mounted in different configurations without modification. Accordingly, the notch 68 defines a top surface 72 and a bottom surface 74 which are respectively above and below the entry 70. Each surface 72, 74 is also spaced between the entry 70 and the base surface 76 of the notch which opposes the entry 70. As shown in FIG. 3, the notch 68 has a generally hexagonal configuration.

The intermediate support 64 depicted in FIG. 3 is mounted on the side of an I-beam 78 having a horizontal central axis 80. Support plate 66 thus defines a plane perpendicular to the axis 80, and the centerline of the notch is approximately at the same elevation as axis 80. Surface 72 is thus above axis 80 while surface 74 is below the axis, and either surface may act as the supporting surface for the plate depending on the mounting orientation of the assembly 68.

Figure 4:
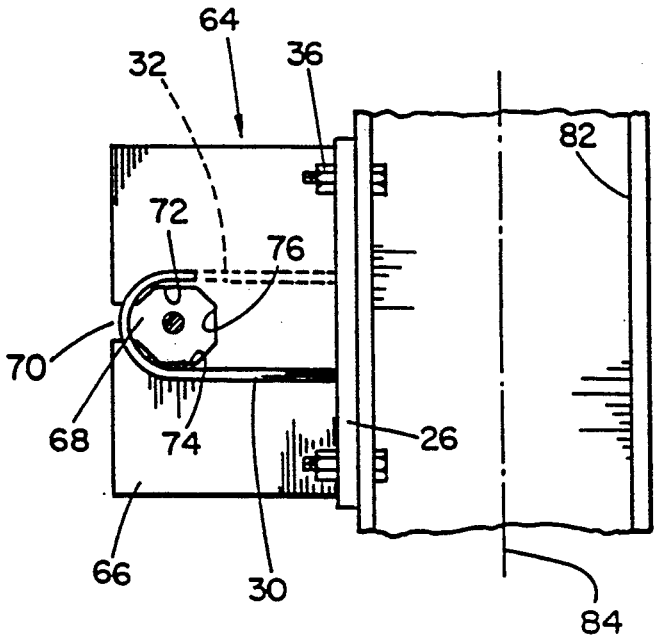
FIG. 4 is an end view of the intermediate support shown in FIG. 3 attached at a different orientation to an I-beam.

FIG. 4 illustrates an end view of the same intermediate support 64 shown in FIG. 3, but with the support 64 mounted to the side of an I-beam 82 having a vertical axis 84. The support 64 is secured to the beam 82 by bolt and nut assemblies 36 passing through apertures 50 in the base plate 26. Accordingly, the plane defined by the supporting plate 66 is substantially parallel to the axis 84 the supporting beam 82. The plate 66 and the J-hooks 30, 32 are preferably welded to the base plate 26, as previously explained. The J-hooks, 30, 32 continue to prevent the cable 12 from inadvertently or intentionally being moved out of the notch 68. Again, the supporting plate is designed to withstand the weight from the cable if the worker should fall, and is preferably designed for safety to withstand approximately 5000 pounds of downward force. The J-hooks 30, 32 are not intended to contribute to the support of the cable if a worker should fall, but provide additional assurance that the cable 12 will be at its desired positioned within the notch 68 of the supporting plate 66 if the worker should fall. The method for passing the lanyard past the intermediate support shown in FIGS. 3 and 4 is similar to the method described for FIGS. 1 and 2. In FIGS. 1 and 2, the end of the lanyard (or the safety hook 24) is sequentially oriented in the downward, then upward, then downward position to pass by the intermediate support 10. For the embodiments are shown in FIGS. 3 and 4, the lanyard (or the safety hook 24) is sequentially oriented to the right side, then the left side, then the right side position to pass by the intermediate support 64.

One of the advantages of the embodiment depicted in FIGS. 1 and 2 is that the plate 28 may be fabricated from steel plate having a thickness of less than three-quarters of an inch, and preferably either one-half inch or five-eights inch nominal steel plate may be used, depending on the strength of the steel and the desired safety factor. For the embodiments depicted in FIGS. 3 and 4, the plate may be fabricated from steel less than one-inch thick, and preferably the plate 66 is fabricated from nominal three-quarters or seven-eights inch thick steel plate. The increased thickness for the plates as shown in FIGS. 3 and 4 is required since the downward force on the cable 12 would create a moment arm on the plate for the embodiments shown in these figures, while the same downward force would merely compress the supporting plate against the supporting beam for the embodiment shown in FIGS. 1 and 2. The J-hooks 30, 32 preferably have a circular cross-sectional configuration, with a diameter of less than about three-quarters of an inch. One of the advantages of the embodiment shown in FIGS. 3 and 4 is that the intermediate support may be mounted to the side of a beam, but may also be mounted to the top of a supporting beam in a manner similar to that shown in FIGS. 1 and 2, so that the entry 70 for the notch 68 is along the uppermost perimeter surface of the supporting plate.

FIGS. 2 and 4 illustrate a further feature of the invention, namely that the intermediate support does not normally engage the cable. In other words, the cable 12 is preferably spaced above the supporting surface of the supporting plate, and neither of the J-shaped hooks normally engage the cable. This feature avoids corrosion between the cable and the intermediate supports, and also eliminates the possibility of cable abrasion which could occur due to vibration if the cable normally rested upon the supporting plate. It should be understood that although eh cable 12 preferably does not normally contact the intermediate support, contact would always occur if the worker were to fall due to the downward force exerted on the cable by the tether.

Various modifications to the embodiments described will be suggested from the foregoing disclosure. By way of example, a mounting or base plate may be welded rather than bolted to a supporting beam. Also, the configuration of this plate may be altered to match the configuration of the outer surface of the supporting member, and accordingly the base plate may be curved if the plate is to be connected to a pipe or other tubular member. The notch in each of the supporting plates is shown in the geometric center of the supporting plate to increase the versatility of mounting the intermediate support. The notch may, however, be provided in the upper portion of the plate 66 for the embodiment shown in FIGS. 3 and 4 to increase the strength of the plate. In other words, if the notch 68 is provided with its entry 70 in the side of the plate but closer to the top of the plate then the bottom of the plate, the increased material of the supporting plate 66 below the notch would provide increased strength for supporting the cable without increasing the size of the intermediate support. A disadvantage of this latter embodiment, however, is that the same intermediate support could not be mounted in the reverse situation, since in that case the reduced material between the notch and the lower edge of the plate would be insufficient to provide the desired support for the safety cable.

It should be understood that the preferred embodiment of the invention includes a single supporting plate and at least two J-hooks on opposing sides of the supporting plate. Additional J-hooks could be provided, however, to further reduce the likelihood that the cable could be moved out of the notch. Also, if the cable is sufficiently taunt, the present invention envisions an intermediate support with a single J-hook provided on either side of the supporting plate.

The term safety cable or fall restraint cable is intended to include any flexible elongate member, and need not be limited to conventional steel rope. Also, those skilled in the art appreciate that the I-beams described for supporting the safety cable, as well as the I-beam to which the intermediate support of the present invention is secured, are merely illustrative, and various conventional structural members may be used for these purposes.

While the invention has thus been described in connection with certain preferred embodiments, it should be understood that the disclosure of these embodiments is not intended to limit the invention. On the contrary, the invention is intended to cover various alternatives, modifications, and equivalents which are included within the scope of the claims.

What is claimed is:

1. Apparatus for providing intermediate support for a fall restraint cable to secure the safety of a worker moveable at elevated locations, the fall restraint cable connected at each end to a fixed structure, and a tether line connected by a clasp secured about and movable along the fall restraint cable to enable the worker to move along the fall restraint cable, the intermediate support apparatus comprising:

a supporting plate having a notch along a periphery thereof for receiving the fall restraint cable, the notch having an engaging surface for positioning below the fall restraint cable for limiting the fall of the worker by restricting the downward travel of the fall restraint cable;

a securing member for attaching the supporting plate to the structure;

a first hook member positioned on one side of the supporting plate, the first hook member having a first restriction portion for preventing the fall restraint cable from moving out of the notch, and having a first mouth opening generally directed toward the securing member; and a second hook member positioned on the other side of the supporting plate, the second hook member having a second restriction portion for preventing the fall restraint cable from moving out of the notch, and having a second mouth opening directed generally toward the securing member.

2. The intermediate support apparatus as defined in claim 1, further comprising:

the securing member including a base plate for affixing to the structure; and the supporting plate secured to the base plate such that a plane defined by the supporting plate is perpendicular to a plane defined by the base plate.

3. The intermediate support apparatus as defined in claim 2, further comprising:

the base plate having a plurality of holes therein; and a plurality of bolts for positioning within respective holes in the base plate to secure the base plate to the structure.

4. The intermediate support apparatus as defined in claim 2, wherein:

the base plate is affixed to an elongate beam having a central beam axis; and the base plate is secured to the beam such that the plane defined by the supporting plate is substantially perpendicular to the beam axis.

5. The intermediate support apparatus as defined in claim 2, wherein:

the base plate is affixed to an elongate beam having a central beam axis; and the base plate is secured to the beam such that the plane defined by the supporting plate is substantially parallel to the beam axis.

6. The intermediate support apparatus as defined in claim 1, wherein:

the notch in the supporting plate has an entry along the periphery of an uppermost portion of the supporting plate; and the notch defines the engaging surface of the base plate for engaging the fall restraint cable if the worker should fall, the engaging surface defined by the notch opposing the entry of the notch.

7. The intermediate support apparatus as defined in claim 1, wherein:

the notch in the supporting plate has an entry along the periphery of a side portion of the supporting plate; and the notch defines the engaging surface of the base plate for engaging the fall restraint cable if the worker should fall, the engaging surface defined by the notch spaced between the entry of the notch and a base surface of the notch opposing the entry of the notch.

8. The intermediate support apparatus as defined in claim 1, wherein:

each of the first and second hook members are substantially J-shaped members having a cantilevered end;

the cantilevered end of the first hook member is positioned on one side of the fall restraint cable, and the cantilevered end of the second hook member is positioned on an opposing side of the fall restraint cable.

9. The intermediate support apparatus as defined in claim 2, wherein:

each of the supporting plate, first hook member and second hook member are welded to the base plate.

10. The intermediate support apparatus as defined in claim 1, wherein:

the supporting plate has a thickness of less than one inch; and each of the first and second hook members have a substantially circular cross-sectional configuration with a diameter of less than three-fourths of an inch.

11. Apparatus for ensuring the safety of a worker movable relative to a fixed structure at elevated locations, including a tether line secured at one end to the worker and connected at the other end to a safety cable connected at each end to the structure, the tether line connected to the safety cable such that the tether line is movable along the safety cable past one or more intermediate supports without disconnecting the tether line from the safety cable, the apparatus comprising:

a clasp member secured to an end of the tether line and encircling the safety cable, the clasp being moveable along the safety cable past the intermediate supports;

the intermediate supports each including a supporting plate having a notch along the periphery thereof for receiving the safety cable, the notch having an engaging surface spaced below the safety cable for limiting the fall of the worker, a securing member for attaching the supporting plate to the structure, and a hook member positioned on one side of the supporting plate and having a restriction portion for preventing the safety cable from moving out of the notch and a mouth opening generally directed toward the securing member.

12. The apparatus as defined in claim 11, further comprising:

the securing member includes a base plate for affixing to the structure;

the supporting plate is secured to the base plate such that a plane defined by the supporting plane is perpendicular to a plane defined by the base plate; and another hook member positioned on an opposing side of the supporting plate and having another restriction portion for preventing the safety cable from moving out of the notch and having another mouth opening generally directed toward the securing member.

13. The apparatus as defined in claim 12, further comprising:

the base plate having a plurality of holes therein;

a plurality of bolts for securing the base plate to the structure;

the supporting plate, the hook member, and the other hook member are each welded to the base plate.

14. The apparatus as defined in claim 11, wherein:

the notch in the supporting plate has an entry along the periphery of an uppermost portion of the supporting plate; and the notch defines the engaging surface of the base plate for engaging the safety cable if the worker should fall, the engaging surface of the notch opposing the entry of the notch.

15. The apparatus as defined in claim 14, wherein:

the base plate is affixed to an elongate beam having a central beam axis;

the base plate is secured to the beam such that the plane defined by the supporting plate is substantially perpendicular to the beam axis;

the supporting plate has a thickness of less than three-fourths of an inch.

16. The apparatus as defined in claim 11, wherein:

the notch in the supporting plate has an entry along the periphery of a side portion of the supporting plate; and the notch defines the engaging surface of the base plate for engaging the safety cable if the worker should fall, the engaging surface of the notch spaced between the entry of the notch and a base surface of the notch opposing the entry of the notch.

17. The apparatus as defined in claim 16, wherein:

the base plate is affixed to an elongate beam having a central beam axis;

the base plate is secured to the beam such that the plane defined by the supporting plate is substantially parallel to the beam axis;

the supporting plate has a thickness of less than one inch.

18. A method of ensuring the safety of a worker movable relative to a fixed structure at elevated locations, the worker being connected to one end of a tether line, the method comprising:

securing a safety cable at each end to the structure;

connecting the other end of the tether line to the safety cable while allowing the other end of the tether line to move along the safety cable;

providing an intermediate support for the safety cable including a base plate, a supporting plate secured to the base plate and having a notch along the periphery thereof defining an entry and an engaging surface, a first hook member secured to the base plate on one side of the supporting plate, and a second hook member positioned on the other side of the supporting plate;

securing the intermediate support to the structure such that an engaging surface defined by the notch is spaced below the safety cable and limits downward movement of the safety cable if the worker should fall; and moving the other end of the tether line along the safety cable past the intermediate support by positioning the other end of the tether line sequentially between a first restriction portion of the first hook and the base plate, then between the engaging surface defined by the notch and the entry of the notch, and then between a second restriction portion of the second hook member and the base plate.

19. The method as defined in claim 18, wherein:

welding one end of the supporting plate to the base plate.

20. The method as defined in claim 18 wherein:

the supporting plate is secured to the base plate such that a plane defined by the supporting plate is substantially perpendicular to a plane defined by the base plate.

* * * * *